United States Patent [19]

Price

[11] Patent Number: 4,484,373

[45] Date of Patent: Nov. 27, 1984

[54] SWEEPER BRISTLE ELEMENT

[76] Inventor: John G. Price, Montgomery, Ala.

[21] Appl. No.: 479,934

[22] Filed: Mar. 29, 1983

[51] Int. Cl.[3] ..... A46B 17/10; A46B 13/02

[52] U.S. Cl. ..... 15/159 A; 15/179; 15/186; 51/334; 300/21

[58] Field of Search ..... 15/159 A, 159 R, 186, 15/187, 188, 179, 180, 181, 182, 183, 198, 200; 51/334, 336, 332

[56] References Cited

U.S. PATENT DOCUMENTS

| | | | |
|---|---|---|---|
| 1,882,769 | 10/1932 | Bugg | 51/334 X |
| 2,608,816 | 9/1952 | Lembke | 51/336 X |
| 3,327,339 | 6/1967 | Lemelson | 15/159 A X |
| 3,871,139 | 3/1975 | Rands | 15/159 A X |
| 4,055,028 | 10/1977 | Belanger | 15/183 X |
| 4,165,778 | 8/1979 | Smith | 15/97 B X |
| 4,184,223 | 1/1980 | Price | 15/159 A |
| 4,221,018 | 9/1980 | Hajdu | 15/159 A X |

FOREIGN PATENT DOCUMENTS

| | | | |
|---|---|---|---|
| 2355479 | 2/1978 | France | 15/159 A |

*Primary Examiner*—Peter Feldman
*Attorney, Agent, or Firm*—Sherman & Shalloway

[57] ABSTRACT

An improved sweeper bristle element is disclosed especially adapted for use on a railway roadbed or track cleaner using a rotating drum onto which a plurality of bristles are fixedly supported. Each bristle element preferably includes an elastomeric stem of 80 durometer hardness with a toe of 60 durometer hardness wrapped around the end and one side of the stem. Rotation of the drum imparts centrifugal force on the bristles causing loose material contacting the toes thereof to be driven away. The stem and toe may be reinforced by fabric and/or spring steel and preferably are laminated together in a vulcanization process. The bristles are formed in a paddle-like configuration which increases the structural strength thereof and makes them simple to install on the drum. If desired, the bristle toe portion may be slitted to render the bristle adaptable to tight situations while maintaining the structural advantages of the paddle-like configuration.

25 Claims, 6 Drawing Figures

1
4
3
2
5
6
L
P
PRIOR ART 107
112
112
112
113
113
113
108
117
101
101

PRIOR ART

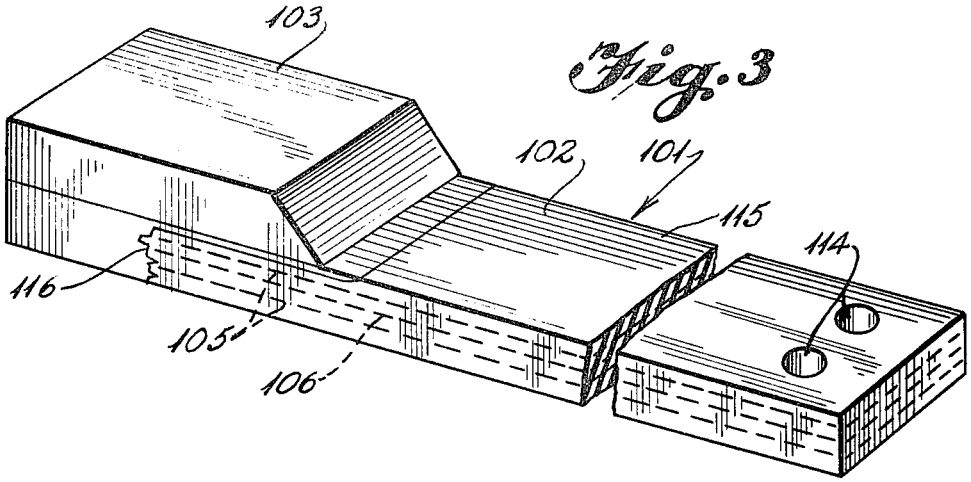
Fig. 3
Fig. 4
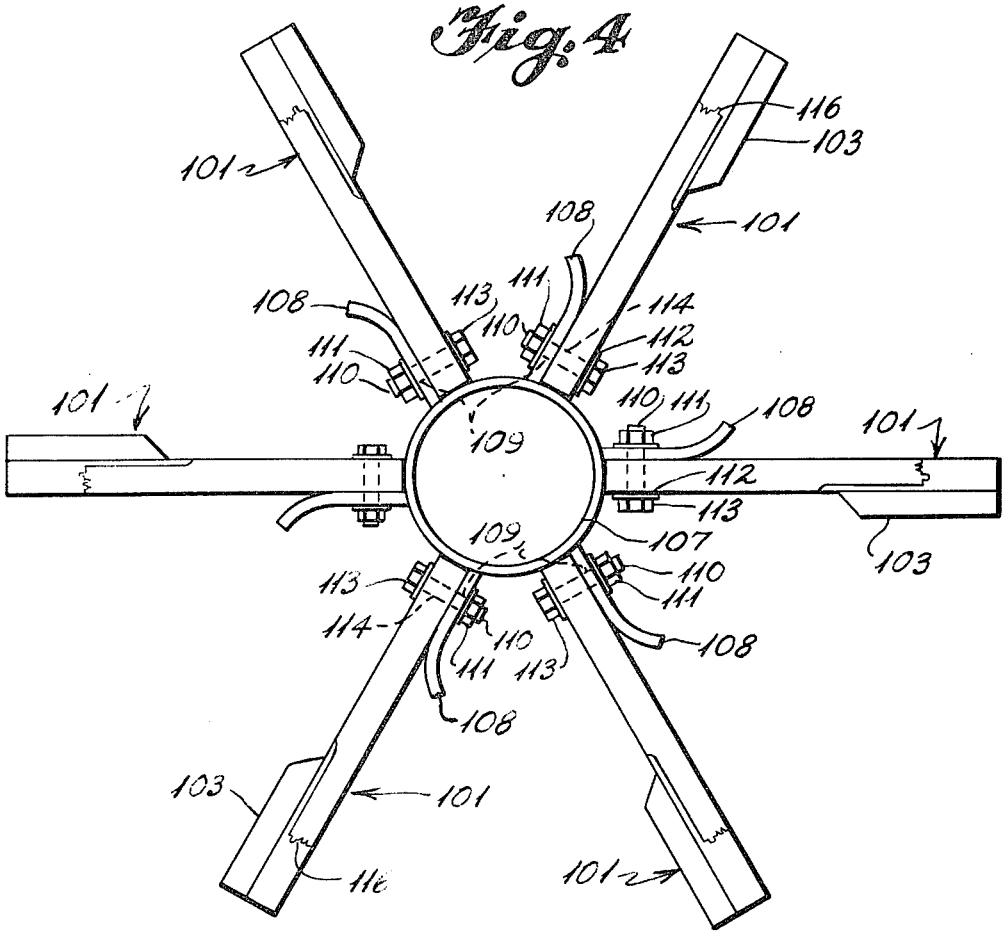

SWEEPER BRISTLE ELEMENT

BACKGROUND OF THE INVENTION

1. Field of the Invention

This invention generally relates to a rotary broom machine especially adapted for construction and maintenance work on a railway roadbed or track, as for dressing the surface of the ballast bed between and along the sides of the rails and for leveling and distributing ballast over the bed.

Particularly, the invention is concerned with a sweeper bristle element used in conjunction with a rotating drum. A plurality of the bristles are mounted on support means attached to the drum and the drum is rotated by the associated machinery to thereby clean the track and level the roadbed.

2. Description of the Prior Art

This invention constitutes an improvement over prior U.S. Pat. No. 4,184,223 titled "Sweeper Bristle Element", the patentee therein being the applicant herein; the disclosure of U.S. Pat. No. 4,184,223 is incorporated by reference herein.

Prior to the advent of the subject matter of U.S. Pat. No. 4,184,223, new ballast dumped upon a track roadbed was roughly distributed by a blade-like plow or moldboard. Since this procedure failed to produce the desired relationship between the rail ties and the ballast level, several broom type implements were developed so as to provide the desired ballast-tie relationship, to wit, the ballast being level with or slightly below the tops of the ties. The sweeping action of the broom bristles against the highly abrasive ballast subjected the bristles to heavy wear and consequently, short bristle and broom life resulted.

One example of these prior art constructions included bristles comprised of lengths of steel cable removably fastened to a mandrel or drum of the broom and encased in heavy duty hose sections to control fraying of the cable. This design was found to yield extremely short life span, sometimes as little as two hours, before replacement was required, and such replacement was quite time consuming and costly in terms of man-hours.

To overcome these problems, the bristle element of U.S. Pat. No. 3,649,984 to Kershaw was developed but unfortunately this bristle, made of a core of parallel straight spring-steel splines or wires fixed together at one end in a detachable coupling and encased in a resilient sheath which binds the splines in mutually supporting relation and distributes flexing stress away from the fixed end, is quite complex to manufacture and expensive to assemble. Further, the life span of the bristles of Kershaw, et al. is not significantly longer than that of bristles prior thereto.

A further advance in the art comprised the subject matter of U.S. Pat. No. 4,184,223. Therein, the patentee (applicant herein) found that a solid bristle of elastomeric material would overcome many of the above discussed disadvantages. Therein, each bristle element comprises a solid hard rubber elastomeric stem, preferably 80 durometer as measured on a Shore, type A, durometer gauge and a solid softer rubber toe integrally laminated thereon, the toe being preferably 60 durometer, again, as measured on a Shore, type A, durometer gauge. The toe is laminated at one end of the stem on one side thereof with the other stem end being adapted to be connected to a rotary broom drum. The elastomeric nature of the bristles renders them much more resistant to wear from abrasive contact with ballast. The bristles are attached to the drum with a combination of nuts, bolts and a clamping member on the side of the bristles opposite the side bearing against the drum. As the drum is rotated, centrifugal force is imparted on the stem and toe, causing loose material contacting the toe to be driven away therefrom.

SUMMARY OF THE INVENTION

The instant invention includes significant improvements over applicant's prior U.S. Pat. No. 4,184,223 in the following particulars:

(a) The bristle is made much wider than that of the prior patent and thus assumes a paddle-like configuration. This increased width results in several advantages over the prior bristle:

(1) Fewer bristles are required to cover the drum face;

(2) The extra width simplifies the mounting of each bristle as further explained below due to the increased structural integrity thereof;

(3) Since there are fewer bristles, there are fewer locations between each bristle thus fewer areas for ricocheting ballast to wear away.

(b) As stated above, mounting of the bristle is simplified. In mounting the prior bristle, a clamping member was required on the side thereof opposite to the side bearing against the drum. The wider configuration of the instant inventive bristle increases the structural strength and integrity thereof, enabling mounting of the bristle on the drum solely through the use of a pair of bolts, washers and nuts. The previously used clamping member may now be omitted.

(c) In situations wherein use of a narrow bristle is required, the inventive bristle may be slit in one or more places in the toe to thereby provide the prior bristle thickness while retaining simplicity of mounting.

(d) It has been found that the bristle will achieve longer life when the toe is laminated over both one side and the end of the stem rather than just over the side as in the prior patent. Accordingly this structural modification has been incorporated into the instant bristle construction.

The following patents are known to applicant, but none of them shows the combination of inventive features disclosed herein:

(1) patents including details of bristle connection to a drum: U.S. Pat. Nos. 808,006, 872,409, 1,168,849, 2,535,637, 3,546,731, 3,942,211 and 4,144,610.

(2) patents including details of bristles with ends slit: U.S. Pat. Nos. 1,767,313, 2,286,650, 2,524,626, 2,599,961, 2,767,526, 3,357,141, 3,834,200 and 4,285,171.

(3) patents including details of bristles with enlarged ends: U.S. Pat. Nos. 3,015,121, 3,134,122, 3,256,545, 3,353,200, 3,384,915, 3,402,416 and 3,871,139.

Accordingly, it is an object of the present invention to disclose a sweeper bristle element including a stem and wrap around toe.

It is a further object of the invention to disclose a sweeper bristle element wherein the stem is made of 80 durometer rubber and the wrap around toe is made of 60 durometer rubber.

It is a still further object of the invention to disclose a sweeper bristle element wherein the stem and toe are integrally laminated together.

It is a yet further object of the invention to disclose a sweeper bristle element formed as a paddle-like entity which results in increased life and greater mounting simplicity.

It is a further object of the invention to disclose a sweeper bristle element which may, if desired, include slits in the toe for increased versatility with retention of mounting ease.

These and other objects and features of the invention will become apparent to those skilled in the art when this specification is read in conjunction with the following drawings:

BRIEF DESCRIPTION OF THE DRAWINGS

FIG. 3 shows a perspective view of the improved bristle.

FIG. 4 shows a side view of a plurality of improved bristles as mounted on a rotary broom drum.

DETAILED DESCRIPTION OF THE INVENTION

Figure 1:
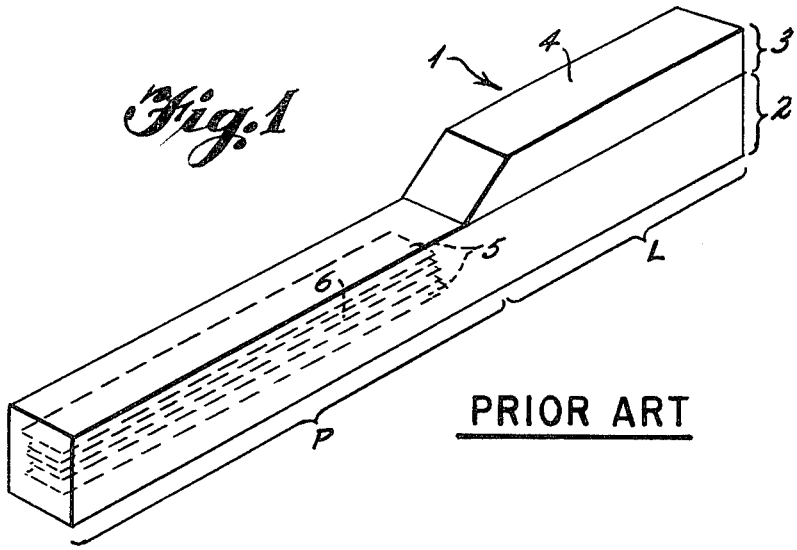
FIG. 1 shows a perspective view of the prior art bristle disclosed in U.S. Pat. No. 4,184,223.

The prior art sweeper bristle element 1, as illustrated in perspective in FIG. 1, is comprised of a solid elastomeric stem 2 which is integrally laminated with a solid weighting mass 3. Preferably, the weighting mass 3 is a solid elastomeric toe forming a forward wearing surface 4. The solid elastomeric stem may optionally be reinforced by a fabric 5, such as nylon, which extends the entire length of the stem 2 parallel to its sides. Alternatively, spring steel 6 in the shape of an "I" beam or other reinforceable shape may be employed as the reinforcing material embedded within the stem 2.

The stem has a lower portion L and an upper portion P. The solid elastomeric toe, which is the weighting mass 3, is integrally laminated to the lower portion L of the solid elastomeric stem 2. Preferably, the length of the stem 2 is approximately eighteen (18) inches and the lower portion L comprises one-third or six (6) inches of the entire length of the stem 2. The cross section of the stem 2 is preferably square and having a one and three eighths inch dimension. The weighting mass 3 is preferably one inch in depth and one and three-eighths inch in width corresponding to the width of the stem 2. It has been found that such dimensions are of a critical nature. For example, substantial extension of the sweeper bristle element 1 beyond eighteen (18) inches results in a structure which is overly flexible. Similarly, substantial decreases in the depth or width of the solid elastomeric stem 2 significantly affects the ability of the stem 2 to properly support the bristle 1 while in use.

The solid elastomeric stem 2 is comprised of an elastomeric material, such as rubber, or a composition blend of rubber and plastic, which has an 80 durometer on a Shore, type-A, durometer gauge. This is considered to be a "hard" type of rubber, thereby allowing the stem 2 to support the bristle 1 straight at all times. The solid weighting mass 3 is preferably comprised of a rubber or composition blend of rubber and plastic which has a 60 durometer on a Shore, type-A, durometer gauge. This is considered a "soft" type rubber and is similar to a high-grade tire tread stock. The forward wearing surface 4, which is preferably planar, is formed by such soft rubber so that maximum resistance to abrasion may be obtained. The toe formed by the soft rubber pad gives the bristle a certrifugal force designed to drive loose material before it, very much like a golf club driving and striking a ball, when the drum is turned at a reasonable speed.

The sweeper bristle element is structured to take advantage of the natural ability of elastomeric materials to out-wear metallic materials, such as steel, many times over in abrasive applications.

Figure 2:
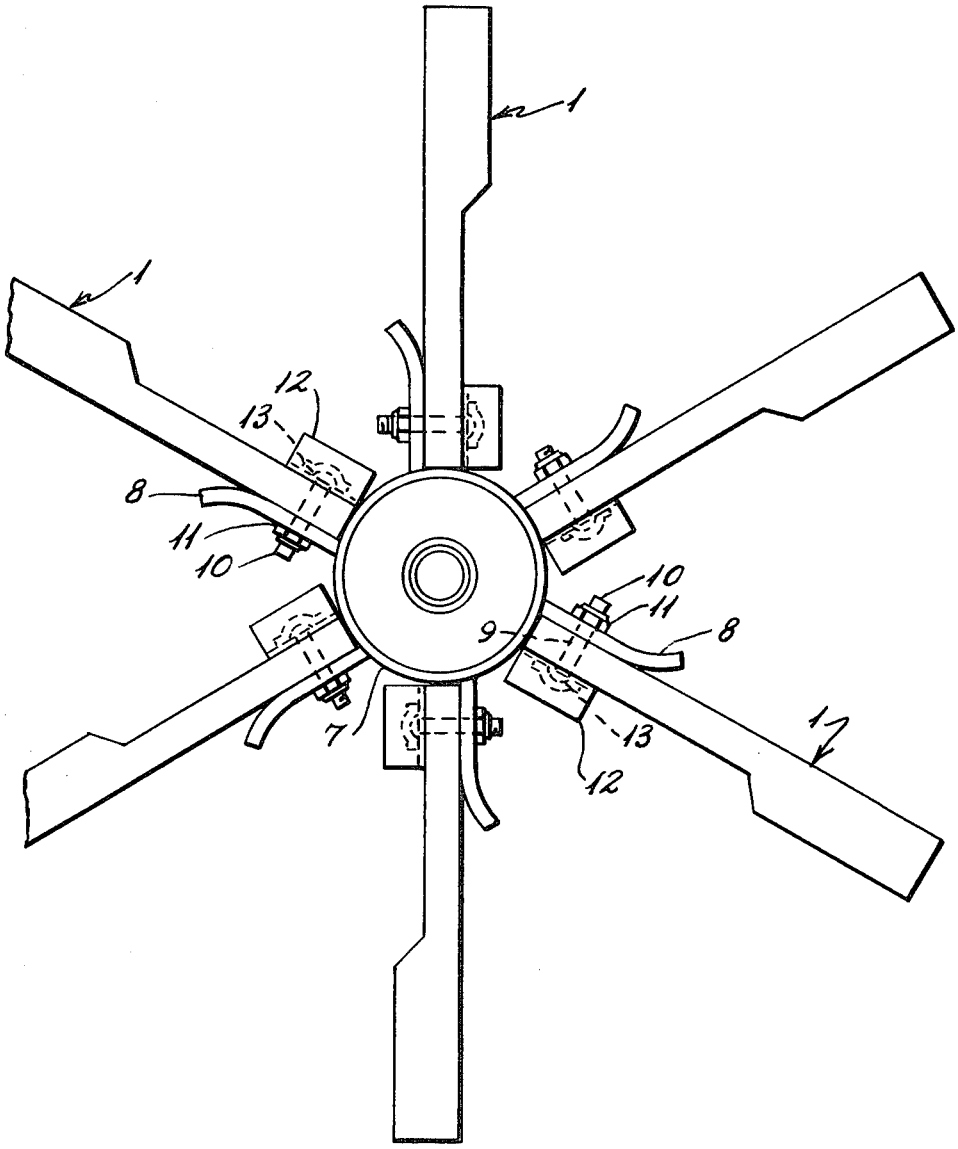
FIG. 2 shows a side view of a plurality of the prior art bristles as mounted on a rotary broom drum.

Referring now to FIG. 2, shown is a plurality of prior art bristles 1 attached to a rotary drum 7. Brackets 8 integrally attached to drum 7 have spaced holes 9 which receive bolts 10. Nuts 11 are threaded onto the ends of respective bolts 10 and bear against respective brackets 8 to retain the bristles in place. Clamping members 12 overlie respective bristle rows and are retained in place by bolt heads 13.

Figure 5:
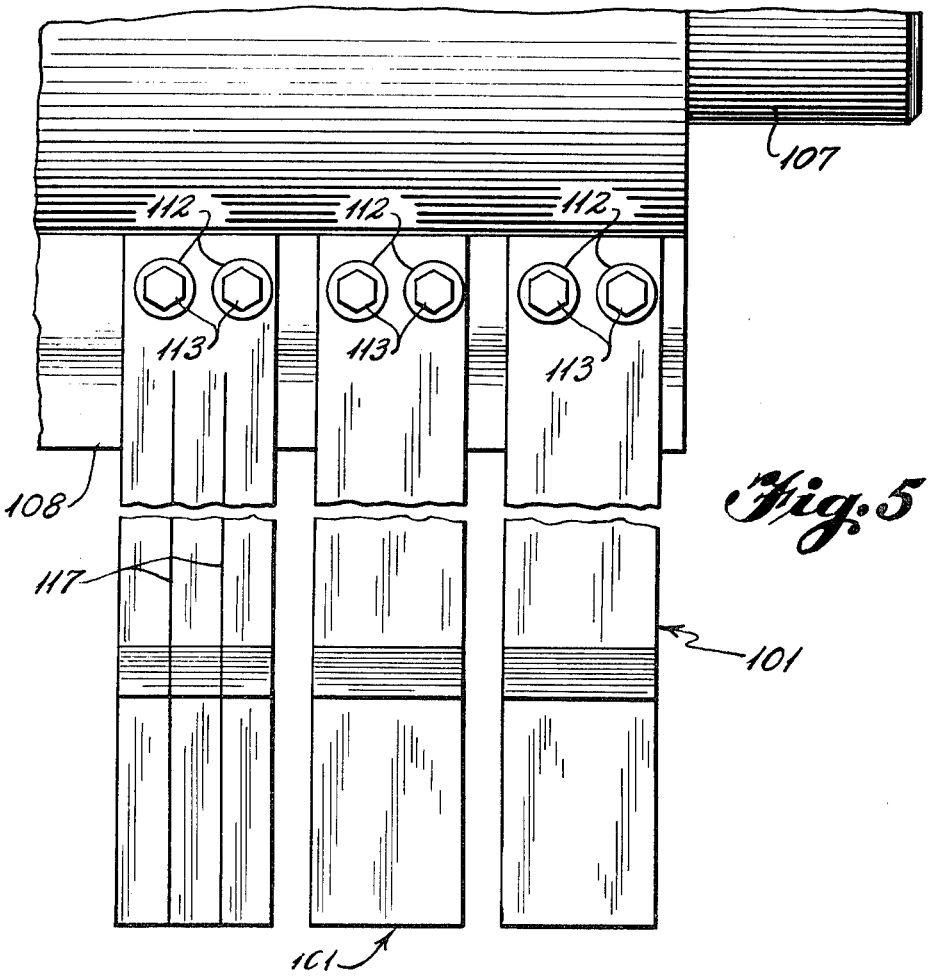
FIG. 5 shows a front view of a plurality of improved bristles mounted on a rotary broom drum shows details of the connection means and toe slits.

New referring to FIGS. 3–5, the new improved bristle element 101 will be described. The bristle element 101 includes, referring to FIG. 3, stem 102 which is integrally laminated to toe 103. As is seen, the toe wraps around the stem, overlying both the face 115 and end 116 thereof. Stem 102 may optionally be reinforced by fabric plies 105 made of a material such as nylon which extends the entire length of the stem 102 parallel to its sides. Alternatively, spring steel 106 in a reinforcing shape such as, for example, and "I" beam may be used as reinforcement for the stem 102. In the prior art bristle 1, the thickness thereof in the direction parallel to the reinforcing fabric planes is significantly less than the thickness in the direction perpendicular to the reinforcing fabric planes. Conversely, in the improved bristle 101 the thickness in the direction parallel to the reinforcing fabric planes is made by a significant margin greater than the thickness in the direction perpendicular to the reinforcing fabric planes. In this way, the bristles assume a paddle-like configuration. This configuration gives the bristle many advantages. A first advantage is the increase in structural integrity. Referring to FIG. 4, the width of the bristles 101 gives sufficient strength to them that clamping means is not needed in attaching them to the drum. The drum 107 includes brackets 108 integrally attached thereto. As shown in FIGS. 4–5, all that is required to fasten the bristles 101 to the drum 107 is bolts 110, nuts 111 and washers 112. Holes 114 formed in each bristle 101 are aligned with holes 109 in each bracket 108 and then bolts 110 are inserted therethrough. Washers 112 retain bolt heads 113 in place thus replacing the cumbersome clamping members 12 required in the prior art construction.

As shown in FIG. 5, if a situation arises wherein bristles whose thickness is on the order of magnitude of the prior art bristles are required, the bristles 101 may be slitted at 117 to satisfy the situation. An example of such a situation is the situation occurring when some track equipment is mounted within two inches of the next piece as with frogs, spur track entrances or exits, crosses or switch gear. In such instances, the slitted bristle 101 has the advantage of narrowness of the prior art bristle 1 while retaining the structural integrity which enables mounting it on the drum 107 solely with bolts 110 and washers 112.

In the preferred embodiment, the paddle-like bristles 101 are made 4 inches wide, $2\frac{3}{8}$ inches thick at the toe and 18 inches long, however, these dimensions may be varied to adapt the bristles to various broom drums and track sizes and shapes, so long as the generally paddle-like configuration is maintained.

Figure 6:
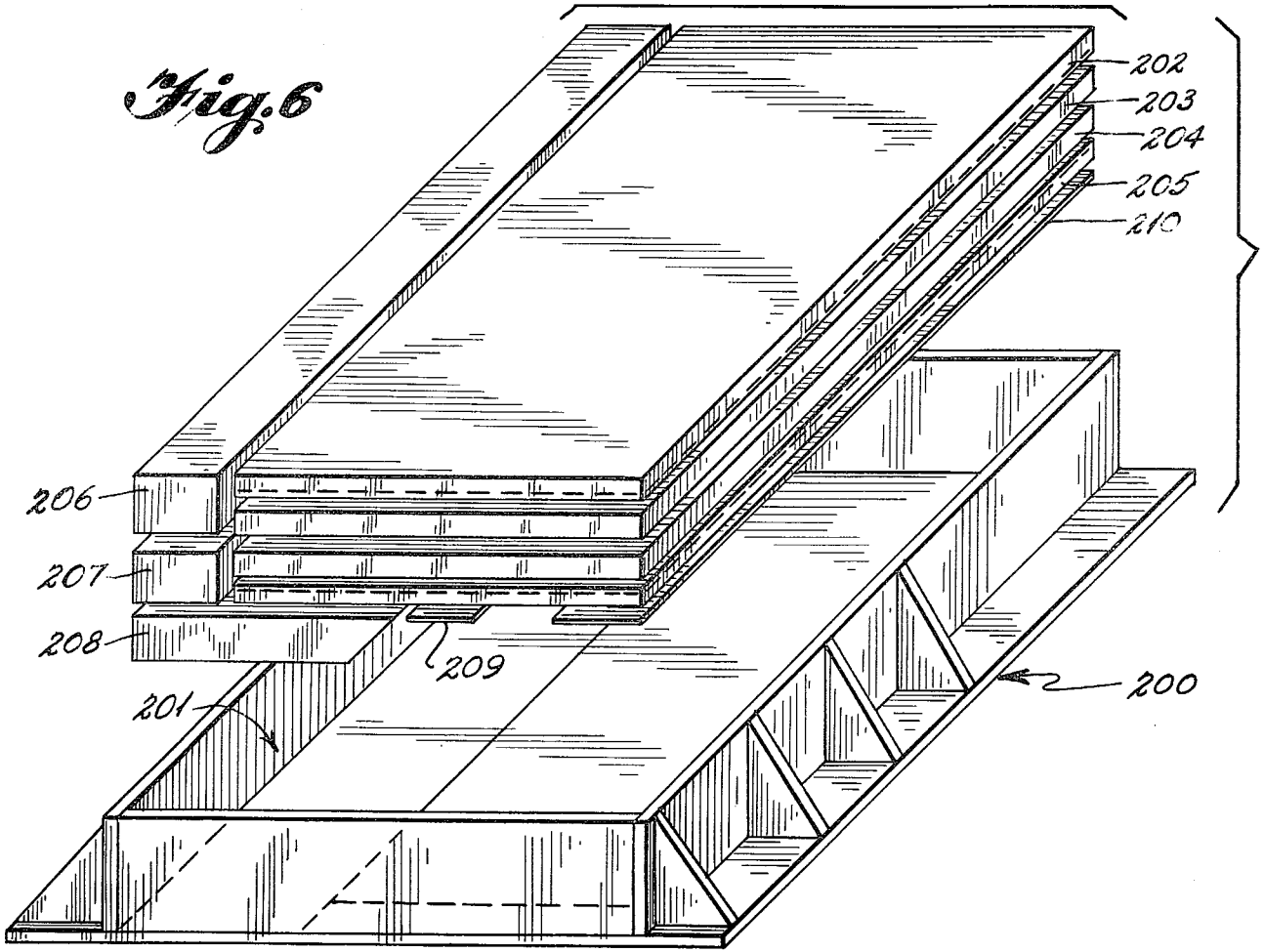
FIG. 6 shows an exploded view of the plurality of members which are laminated together in the shown mold to form the finished improved bristle.

With reference now to FIG. 6, the preferred method of manufacturing the improved bristle elements will be described. Mold 200 is made with a cavity 201 sized to receive the materials from which the bristles will be formed. Sheets of elastomeric material 202, 203, 204 and 205 will form the stem portion with sheets 202 and 205 being pre-formed with reinforcing material. The sheets 202, 203, 204 and 205 are preferably made of an 80 durometer elastomeric material 206, 207 and 208, preferably made of 60 durometer elastomeric material will form the toe portion. If desired, an identification label 209 may also be included as well as additional fabric reinforcement material 210. All elements 202–210 are then placed into mold cavity 201, covered, and then the entire structure is laminated through vulcanization into a single entity therein. The fabric 210 is included to prevent bolt heads 113 from pulling through stem 102 during rotary operation of the drum.

After the vulcanization is completed, the finished structure is cut into the desired thickness and slits, if necessary, are cut therein. The materials used to form the bristle 101 may include any elastomeric material such as, for example, rubber and combinations of, rubber and plastic. If desired, methods other than vulcanization may be used to form the bristles, for example, molding or extrusion techniques.

Various changes may be made in the details of this invention, as disclosed, without departing from the scope of the following claims or sacrificing the advantages thereof. Furthermore, although the present invention has been disclosed with particular regard for its use as a sweeper bristle element for use on a railway roadbed or track cleaner as mounted on a rotating drum, it should be understood that the invention may be used in any industrial application wherein loose materials are to be moved or leveled.

What is claimed is:

1. An improved sweeper bristle element comprising:

(a) a solid elastomeric stem having a first end and a second end and a substantially rectangular cross-section adjacent said second end defining four stem sides;

(b) a solid elastomeric toe laminated to said stem, said toe overlying and being laminated to solely one of said four stem sides and said second end of said stem.

2. The improved sweeper bristle element of claim 1, wherein said first end of said stem is provided with means for attaching said stem to element support means formed as a part of a rotary drum.

3. The improved sweeper bristle element of claim 2, wherein said attaching means comprises at least one hole formed in said stem and at least one headed bolt, washer and nut, said washer being located adjacent the head portion of said bolt and said nut being threaded onto said bolt, said nut bearing against said element support means to retain said bristle element thereon.

4. The improved sweeper bristle element of claim 3, wherein said attaching means solely comprises a plurality of holes and corresponding bolts, washers and nuts.

5. The improved sweeper bristle element of claim 3, further including first reinforcing means on said stem surrounding said at least one hole for preventing tearing of said stem by said washer and bolt head portion.

6. The improved sweeper bristle element of claim 1 or 3, wherein said toe includes at least one slit formed therein.

7. The improved sweeper bristle element of claim 6, wherein a plurality of slits are formed in said toe.

8. The improved sweeper bristle element of claim 1, wherein said bristle element defines a length dimension from said stem first end to the extremity of that portion of said toe overlying said stem second end, a thickness dimension perpendicular to said substantially flat surface of said stem and located where said toe overlies said substantially flat surface and a width dimension perpendicular to said thickness dimension, said width dimension being substantially greater than said thickness dimension whereby said bristle element at the region of said toe and said second end of said stem has a paddle-like configuration.

9. The improved sweeper bristle element of claim 8, wherein said toe includes at least one slit formed therein.

10. The improved sweeper bristle element of claim 9, wherein a plurality of slits are formed in said toe.

11. The improved sweeper bristle element of claim 2, wherein said rotary drum forms an integral part of a railway roadbed or track cleaner.

12. The improved sweeper bristle element of claim 1, wherein said stem is formed of a first elastomer having an 80 durometer measured on a Shore, type-A, durometer gauge, and said toe is formed of a second elastomer having a 60 durometer measured on a Shore, type-A, durometer gauge.

13. The improved sweeper bristle element of claim 12, wherein said first elastomer is a composition blend of rubber and plastic.

14. The improved sweeper bristle element of claim 12, wherein said first elastomer is rubber.

15. The improved sweeper bristle element of claim 12, 13 or 14, wherein said second elastomer is a composition blend of rubber and plastic.

16. The improved sweeper bristle element of claims 12, 13 or 14, wherein said second elastomer is rubber.

17. The improved sweeper bristle element of claim 5, wherein said stem further includes second reinforcing means extending substantially from said first end to said second end.

18. The improved sweeper bristle element of claim 1, wherein said stem further includes reinforcing means extending substantially from said first end to said second end.

19. The improved sweeper bristle element of claim 18, wherein said reinforcing means comprises at least one fabric ply.

20. The improved sweeper bristle element of claim 18, wherein said reinforcing means comprises at least one metal sheet.

21. The improved sweeper bristle element of claim 19, wherein said reinforcing means further comprises at least one metal sheet.

22. In a sweeper bristle element including a solid elastomeric stem having a first end, and having a substantially rectangular cross-section, defining four sides adjacent a second end, and a solid elastomeric toe laminated to said second end, the improvement comprising: said toe having a width substantially greater than its thickness whereby the toe has a paddle-like configuration, and, said toe being vulcanized solely to one of said sides and said second end.

23. The invention of claim 22, wherein said toe includes a face located in a plane substantially parallel to said width, said face being adapted to engage loose materials and repel them when said bristle element is rotated by a rotary drum-type sweeper.

24. An improved sweeper bristle element comprising:

(a) a solid elastomeric stem having a first end and a second end and a substantially flat surface adjacent said second end;

(b) a solid elastomeric toe laminated to said stem, said toe overlying and being laminated to both said surface and said second end of said stem and further wherein said first end of said stem is provided with means for attaching said stem to element support means formed as a part of a rotary drum, said attaching means comprises at least one hole formed in said stem and at least one headed bolt, washer and nut, said washer being located adjacent the head portion of said bolt and said nut being threaded onto said bolt, said nut bearing against said element support means to retain said bristle element thereon and further wherein said toe includes at least one slit formed therein.

25. An improved sweeper bristle element comprising:

(a) a solid elastomeric stem having a first end and a second end and a substantially flat surface adjacent said second end;

(b) a solid elastomeric toe laminated to said stem, said toe overlying and being laminated to both said surface and said second end of said stem and further wherein said bristle element defines a length dimension from said stem first end to the extremity of that portion of said toe overlying said stem second end, a thickness dimension perpendicular to said substantially flat surface of said stem and located where said toe overlies said substantially flat surface and a width dimension perpendicular to said thickness dimension, said width dimension being substantially greater than said thickness dimension whereby said bristle element at the region of said toe and said second end of said stem has a paddle-like configuration, said toe including at least one slit formed therein.

* * * * *